US007235165B2

(12) United States Patent
Lacey

(10) Patent No.: US 7,235,165 B2
(45) Date of Patent: Jun. 26, 2007

(54) ELECTROPLATING SOLUTION AND METHOD FOR ELECTROPLATING

(76) Inventor: Richard Lacey, P.O. Box 345, Monroe, WA (US) 98272

( * ) Notice: Subject to any disclaimer, the term of this patent is extended or adjusted under 35 U.S.C. 154(b) by 54 days.

(21) Appl. No.: 11/045,414

(22) Filed: Jan. 27, 2005

(65) Prior Publication Data

US 2005/0230264 A1 Oct. 20, 2005

Related U.S. Application Data

(63) Continuation-in-part of application No. 10/817,037, filed on Apr. 2, 2004, now abandoned.

(51) Int. Cl.
*C25D 5/06* (2006.01)
*C25D 3/02* (2006.01)

(52) U.S. Cl. ..... 205/117; 205/238; 205/240; 205/255; 205/261; 205/263; 205/266; 205/270; 205/271; 205/291; 205/299; 205/205

(58) Field of Classification Search ..... 502/117, 502/238, 240, 255, 261, 263, 266, 270, 271, 502/291, 299, 305, 817, 37
See application file for complete search history.

(56) References Cited

U.S. PATENT DOCUMENTS

| | | | | |
|---|---|---|---|---|
| 3,642,588 | A | 2/1972 | Charrier | |
| 3,642,591 | A | 2/1972 | Boose et al. | |
| 3,725,214 | A | 4/1973 | Bride | |
| 4,024,031 | A | 5/1977 | Lerner | |
| 4,113,248 | A | 9/1978 | Yanagioka | |
| 4,155,817 | A | 5/1979 | Fletcher et al. | |
| 4,276,323 | A | 6/1981 | Oka et al. | |
| 4,578,156 | A | 3/1986 | Plazter | |
| 4,610,763 | A * | 9/1986 | Law | 205/184 |
| 5,302,464 | A | 4/1994 | Nomura et al. | |
| 5,470,636 | A | 11/1995 | Wakui et al. | |
| 5,534,128 | A | 7/1996 | Aso et al. | |
| RE35,513 | E | 5/1997 | Nobel et al. | |
| 6,099,624 | A | 8/2000 | Martyak | |
| 6,200,450 | B1 * | 3/2001 | Hui | 205/82 |
| 6,251,249 | B1 | 6/2001 | Chevalier et al. | |
| 6,406,611 | B1 | 6/2002 | Engelhaupt et al. | |
| 6,544,398 | B2 | 4/2003 | Uchida et al. | |

OTHER PUBLICATIONS

F. A. Lowenheim, Electroplating, McGraw-Hill Book Co., New York, 1978, pp. 152-155.*

Fredrick A. Lowenheim, Electroplating, McGraw-Hill Book Co., New York, 1978, pp. 115-121.

Metal Finishing Guidebook and Directory for 1975, Metals and Plastic Publications, Inc., Hackensack, N.J., 1975, pp. 394-397.

Julius Grant, editor, Hackh's Chemical Dictionary, fourth edition, McGraw-Hill Book Co., New York, 1969, pp. 436.

Nyborg, R.L., Hobbyist Electroplating Made Easy, Regal Publications, 1989.

* cited by examiner

*Primary Examiner*—Roy King
*Assistant Examiner*—William T. Leader
(74) *Attorney, Agent, or Firm*—Dowrey Rickards PLLC

(57) ABSTRACT

An electroplating solution may be formulated as an aqueous solution of oxalic acid, trisodium phosphate and ammonium sulfate. Such solutions may be used for both brush plating and bath plating, and are suitable for use with a variety of plating metals and substrate metals without the need to add plating metal ions to the solution in the form of metal salts, chelates or complexes.

17 Claims, 1 Drawing Sheet

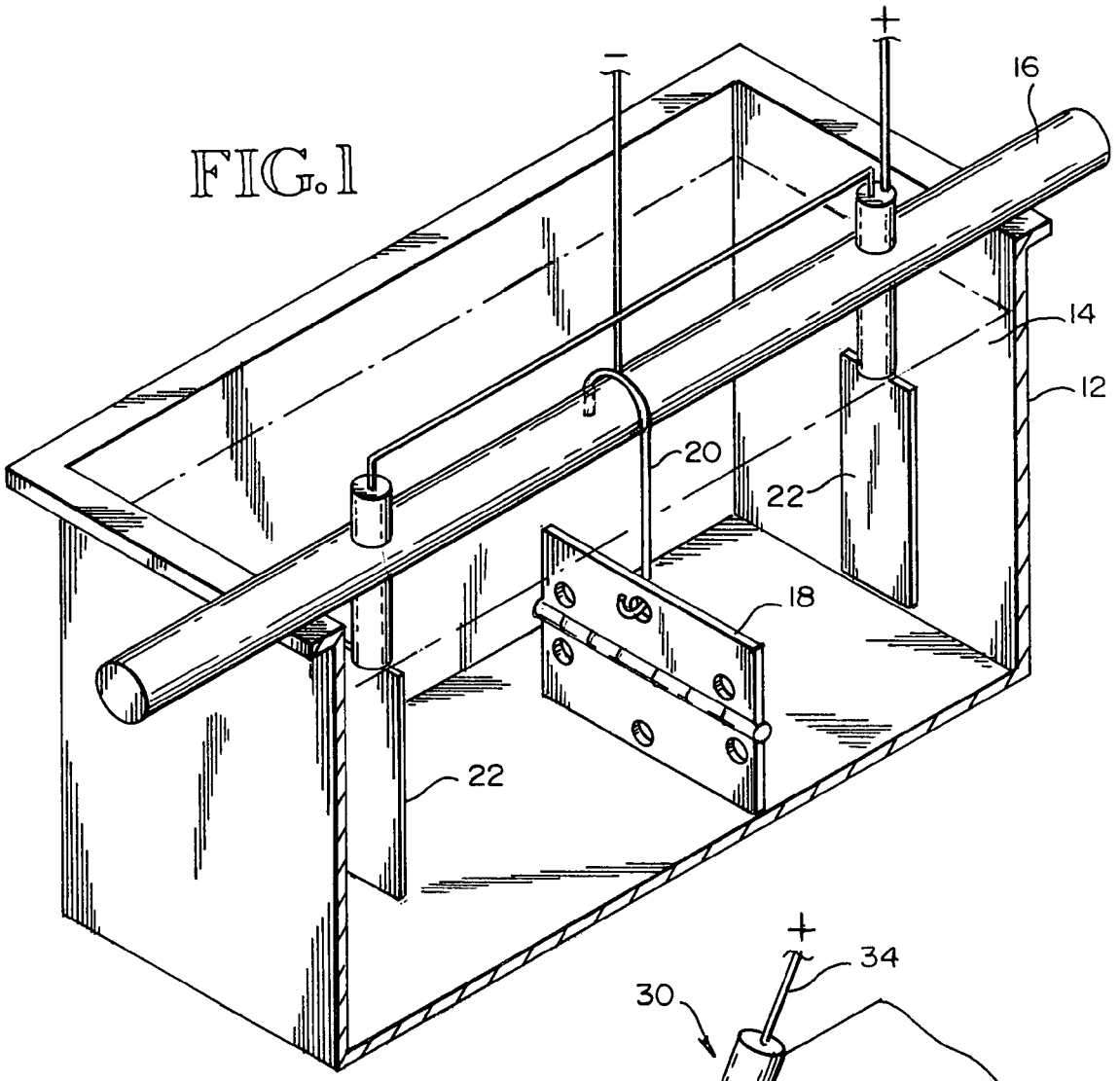
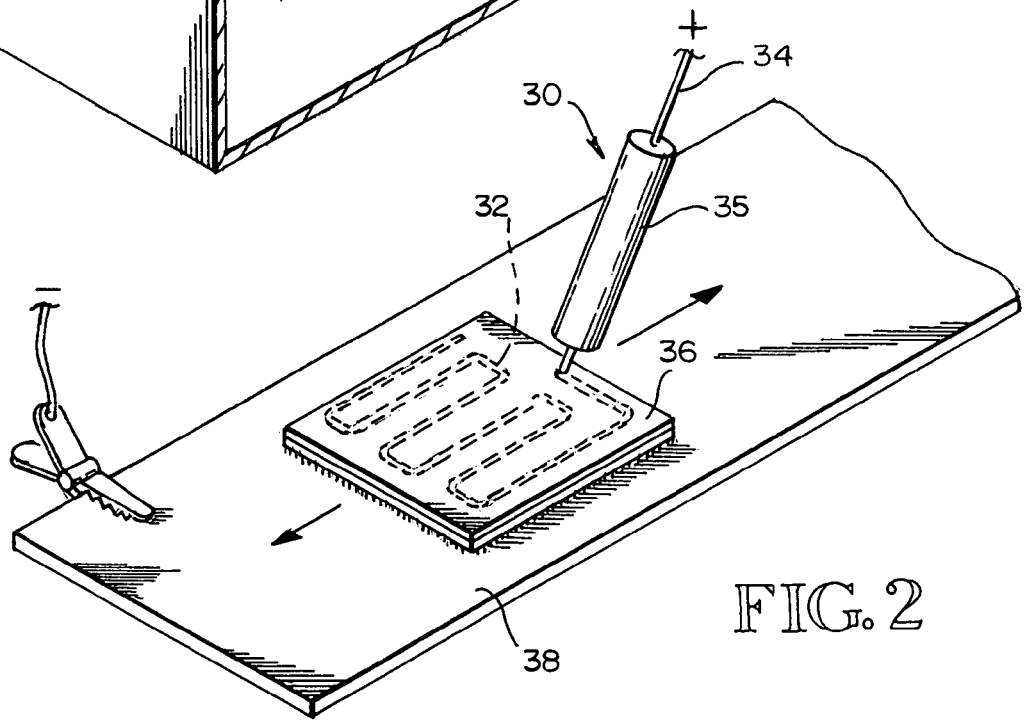
FIG. 2

ELECTROPLATING SOLUTION AND METHOD FOR ELECTROPLATING

CROSS REFERENCE TO RELATED APPLICATIONS

The present application is a Continuation-in-Part of the application entitled Electroplating Solution And Method For Electroplating filed Apr. 2, 2004, Ser. No. 10/817,037, now abandoned.

FIELD OF THE INVENTION

The present invention relates to electroplating solutions and methods for electroplating metal articles using such solutions.

BACKGROUND OF THE INVENTION

Due to the toxic materials employed, government regulation of businesses that perform electroplating is presently fairly stringent, and the regulations regarding emissions from electroplating facilities have increased the costs of doing business. As a result, many electroplating businesses have closed, and a significant portion of the electroplating work formerly performed by these businesses has migrated to foreign countries.

Conventional electroplating technology has employed and continues to employ toxic chemicals that are hazardous both to the workers carrying out the electroplating and to the environment. For example, various solutions for silver, gold and zinc electroplating have included sodium cyanide or other cyanide-containing compound. Acidification of such electroplating bath can result in generation of toxic hydrogen cyanide gas. Similarly, solutions having a chloride component can generate chlorine gas at the cathode.

Handling of spent solutions can also be problematic. Solutions containing heavy metals and other toxic chemicals may require special treatment before they can be safely disposed. Toxic chemicals remaining on the plated article may also present problems, as rinse water treatment may also be required.

Electroplating solutions usually include the plating metal ion in solution. For example, in U.S. Pat. No. Re. 35,513, one electroplating solution for electroplating of copper includes cuprous chloride, and a solution for plating of silver includes silver chloride. As a result, the plating solution can only be used for plating the metal for which it has been formulated. For example, a solution used for nickel plating cannot be used for copper plating. In addition, the level of plating metal ion must be monitored and supplemented from time to time in order to maintain the bath. The chemical tests required to maintain the desired balance in the bath are complicated and expensive, and only larger plating businesses are likely to have the necessary supplies, equipment and training to conduct them in house.

Current plating technology also frequently utilizes a plurality of baths for pretreating and plating, which may be specific to a particular plating metal and/or substrate metal. If the plater wishes to plate various different plating metals on various different substrate metals ("substrate metals" refer to metals on which the plating metal is plated, and does not indicate that the metal is common or impure), the number of solutions and baths that have to be maintained can be multiplied to the point that the plating operation becomes very costly and requires a large space. Smaller consumers of plating thus have been increasingly outsourcing their plating needs, with attendant increases in cost and time spent rather than dedicating the necessary resources for environmental compliance, testing, storage of plating solutions, changing of baths, and so forth.

SUMMARY OF THE INVENTION

In one aspect, the plating method and plating solution allow single step plating. The plating solution of this aspect may comprise a poly-functional organic acid or acid salt, such as oxalic acid, ammonium sulfate and a phosphate such as trisodium phosphate. In another aspect, the plating solution may be used for bath plating as well as brush plating without including the plating metal salt in the solution. Rather, according to this aspect, the sole source of the plating metal may be the anode.

In an aspect of the invention relating to bath plating, the substrate metal on which the plating is to be applied is submerged in the solution and one or more plating metal anodes are used. In an aspect of the invention relating to brush plating, an insulating absorbent material, such as a natural or synthetic felt is secured to a plating metal anode, and the absorbent material is saturated with the plating solution. The anode, insulated by the felt, is rubbed over the substrate metal cathode to deposit a plating layer.

In another aspect, salts of a plating metal are included in the electroplating solution.

In another aspect, once plating has been completed, residual metal ions are removed from the plating solution using an inert anode, such as a carbon anode, and a cathode such as copper, iron or other substrate metal that can receive the residual plating metal ions.

In another aspect, the plating solution is substantially free of cyanide and chloride compounds, although trace amounts of cyanide or chloride may be present.

BRIEF DESCRIPTION OF THE DRAWINGS

FIG. 1 is a perspective view of a plating bath for use with the method of the present invention with some parts shown in phantom.

FIG. 2 is a perspective view of a brush plating wand being used to plate a metal surface with some parts shown in phantom.

DETAILED DESCRIPTION OF EMBODIMENTS OF THE INVENTION

Bath and brush electroplating both involve the use of plating solutions. According to one embodiment of the invention, and referring to FIG. 1, a bath type plating apparatus 10 comprises a bath 12 containing a plating solution 14. The bath may be made of an inert material, such as glass, plastic or composites, or, if desired, of the plating metal as explained more fully below. One or more non-conductive support arms 16 extend over the top of the bath 12. An article 18 to be plated is suspended in the plating solution 14 by a conductive hanger 20.

The hanger 20 is, in turn, connected to the negative terminal of a direct current power supply (not shown), which may be a simple battery or battery charger, such as a 6V or 12V, 10 amp automotive battery charger. More sophisticated DC power supplies that allow closer control of current and voltage levels are available for electroplating purposes and may be used in practicing the present invention.

One or more soluble plating metal anodes 22 that depend from the arm 16 are immersed in the bath 14, and are connected to the positive terminal of the DC power supply. Multiple anodes 22 may be used where more than one side of the article requires plating or where a more uniform layer of plating is desired. In addition, the bath 12 may be made of the plating metal, with the positive terminal of the DC power supply being connected to the bath 12 itself, making the bath 12 into the plating metal anode 22. Of course, in such case, the life of the bath 12 would be dependent on the amount of plating for which it is used, since the plating process would remove metal from the interior of such a bath.

According to one embodiment, plating is accomplished by submerging the article 18 in an aqueous solution comprising quantities of a water-soluble, polyfunctional organic acid, such as oxalic acid (ethanedionic acid), trisodium phosphate and ammonium sulfate. For example, the solution may comprise 32 g oxalic acid, 10 g trisodium phosphate and 4 g ammonium sulfate in 0.95 L water. Salts of the plating metal may also be dissolved in the solution.

Oxalic acid, trisodium phosphate and ammonium sulfate were chosen for their functionality, and also because they are comparatively less toxic, environmentally friendly, economical and readily available than other chemicals. It appears likely that other chemicals could be used to provide the same levels of oxalate, phosphate, ammonium and sulfate ions, such as by replacing a portion of the oxalic acid with ammonium oxalate and a portion of the ammonium sulfate with sulfuric acid, but the cost of doing so would likely be greater than the cost of using oxalic acid, trisodium phosphate and ammonium sulfate, and the handling of sulfuric acid may not be desired.

Disodium EDTA (ethylene diamine tetra acetic acid) was also tried in like proportions to, and in the place of, the oxalic acid. This solution was also usable for plating, although it did not work as well as the aforementioned, oxalic-acid-based solution, and the cost of the disodium EDTA was substantially greater than that of the oxalic acid.

Although many electroplating solutions include cyanide and chloride compounds, such compounds are not required in the present electroplating solution and the solution may be free of cyanide and chloride compounds, although trace amounts of chloride may be present as, for example, in various grades of trisodium phosphate useable in formulating plating solutions according to the present invention. The absence of such compounds may be desired as both cyanide gas and chlorine gas are harmful and noxious. In addition, the presence of cyanide compounds, in particular, could complicate environmentally sound disposal of the solution and so forth.

The foregoing components of the solution may be beneficial in respect to health and safety of workers and to protection of the environment. Oxalic acid is present in many vegetables. For example, carrots, cassava and chives have oxalic acid contents of 0.5 g or more per hundred grams, and parsley has an oxalic acid content of 1.7 g per 100 grams. Ammonium sulfate is used in fertilizer and trisodium phosphate is sold for use in various cleaning tasks, such as washing of decks and house exteriors. While skin and eye contact, respiration and ingestion of all of these compounds should be avoided or minimized, they are certainly all more benign than chemicals such as cyanide and other chemicals commonly used in plating.

Plating solutions of the aforementioned type have been successfully used to plate layers of brass, copper, nickel, zinc, silver, gold, iron, molybdenum-nickel-based alloys such as that sold under the Monel trademark, lead and stainless steel onto the substrate metal, and the substrate metal may be aluminum, steel, copper, brass, steel, stainless steel, lead, zinc, nickel and other substrate metals. Metal alloys may be made by providing anodes of different metals. For example, zinc and copper anodes were used simultaneously to produce a layer of brass on a cathode. Likewise, tin and copper anodes were used to produce bronze. Nickel and iron anodes were used to make a nickel steel plating. Other alloys can be plated onto a substrate in like manner using two or more anodes. The electroplating solutions have been able to accomplish this without the addition of plating metal salts, chelates, complexes or the like to the plating solution. The plating solution may be usable with other plating metals and substrate metals. Rather, the plating metal was provided solely by the anode. Plating has been performed at moderate temperatures (about 16° C.-60° C.), and was not particularly temperature sensitive. In some cases, with some formulations, a dark oxide coating formed on the plated metal. This condition could be corrected by wiping the deposit off in some cases, or, in the case of some solutions, by increasing the oxalic acid concentration by 10%.

Soluble salts of the plating metal may be added to the electroplating solution if desired. Such salts may include nitrates, sulfates, halides and the like, although use of halides may result in hydrogen chloride gas being evolved from the electroplating solution during the plating process. However, the addition of such salts can be avoided by the use of a plating metal anode of sufficient surface area and mass. Where such electrodes are used, the electroplating solution can be charged with the plating metal by the flow of current between the plating metal anode and the cathode. This avoids the need to add plating metal salts or the like to the electroplating solution.

Current flow between the anode and cathode can be controlled by varying the distance between the anode and cathode and by diluting the electroplating solution or formulating it in a more concentrated form.

As shown in FIG. 2, and according to another embodiment of the invention, a brush plating wand 30 may be used for plating a substrate metal. In its simplest form, the wand comprises a soluble anode portion 32 and conductive handle portion 34. A non-conductive shield 35 may be provided to insulate the handle portion 34 in case of contact with the cathode. At least a portion of the anode portion 32 is covered with an absorbent material 36 that is not itself electrically conductive and that can absorb and retain a quantity of the plating solution. The absorbent material 36 serves to space the anode portion 32 from the surface of the substrate metal article 38 which is to be plated, and to insulate the anode portion 32 and substrate metal article 38 from one another to avoid a short circuit condition.

According to one embodiment, plating is accomplished by dipping the absorbent material 36 of the wand 30 in a plating solution such as those described herein, connecting the wand to the positive terminal of the DC power supply and the substrate metal 38 to the negative terminal, and rubbing the wand 30 over the surface of the substrate metal 38 until a sufficient quantity of the plating metal has been deposited on the desired area of the substrate metal. Additional solution may be applied to the absorbent material 36 of the wand 30 as needed.

The plating solution discussed above represents one formulation and may be used with a variety of plating metal/substrate metal pairs.

EXAMPLE I

A plating solution of 32 g oxalic acid, 10 g trisodium phosphate and 4 g ammonium sulfate in 0.95 L (1 qt.) distilled water was prepared and placed in a non-metallic bath. Strips of copper, lead, aluminum and aluminum foil cathodes were prepared, together with anodes of brass, lead, zinc, stainless steel and steel. The anodes and cathodes were sequentially placed in a bath containing the solution, and power was supplied to the cathode and anode by a battery charger set to 6 v or 1 2V, as noted, at about one ampere per square inch of cathode for a period of about 30 minutes each. At the conclusion of this time period, a decorative plating of the plating metal had been deposited on the cathode in most cases. After one article had been plated as set forth above, the same decorative surface plate could be applied to a second article in about half the time, indicating that the plating solution had been charged with plating metal removed from the anode. The results of this experiment are set forth in Table 1 below. The temperature of the solution throughout its use was approximately 27° C. (80° F.) except as otherwise noted. The results were taken at fifteen minutes unless otherwise noted.

TABLE 1

| Cathode | Anode | Comments |
|---|---|---|
| Copper | Nickel | |
| Copper | Zinc | Solution at 16° C., 6 v |
| Copper | Zinc | Solution at 16° C., 12 V |
| Copper | Stainless Steel | Solution at 16° C. |
| Copper | Stainless Steel | Solution at 38° C. |
| Copper | Steel | |
| Copper | Lead | |
| Aluminum | Brass | |
| Aluminum foil | Brass | |
| Lead | Brass | |

Plating of metals onto aluminum was found to require a slightly greater amount of time than for the other metals.

After plating, the plating metal in solution can thereafter be removed by replacing the anode with an inert material, such as a carbon rod and replacing the cathode with another, such as a copper strip or pipe, and continuing to pass electric current through the solution. Upon so doing, the solution may thereafter be used for the plating of a different plating metal onto another article.

EXAMPLE II

The concentration of the components of the plating solution can be varied while still maintaining the ability of the solution to support the plating of a wide variety of metals onto a wide variety of substrate metals. For this example, copper was chosen as the substrate metal and nickel and zinc were chosen as the plating metals. Solutions were prepared as described above based on the 32:10:4 ratio of oxalic acid, trisodium phosphate and ammonium sulfate, except that the concentrations of each of the components in turn were varied while the concentrations of the remaining components were maintained at the stated ratio. For example, as discussed below, 32 g oxalic acid and 10 g trisodium phosphate sulfate might be used to make solutions together with, respectively, 2 g, 6 g, 8 g, 10 g and 12 g of ammonium sulfate. The plating was successful unless otherwise noted.

TABLE II

| Nickel anode, copper cathode | | | |
|---|---|---|---|
| Oxalic Acid | Trisodium Phosphate | Ammonium Sulfate | Comments |
| 16 g | 10 g | 4 g | Thin plating, some darkening |
| 48 g | 10 g | 4 g | |
| 64 g | 10 g | 4 g | Solution temperature 63° C. - plating uneven |
| 32 g | 10 g | 2 g | Thin |
| 32 g | 10 g | 6 g | Slight darkening |
| 32 g | 10 g | 8 g | Dark plating |
| 32 g | 4 g | 4 g | Very slow |
| 32 g | 5 g | 4 g | |
| 32 g | 6 g | 4 g | |
| 32 g | 15 g | 4 g | |

TABLE III

| Zinc anode, copper cathode | | | |
|---|---|---|---|
| Oxalic Acid | Trisodium Phosphate | Ammonium Sulfate | Comments |
| 32 g | 10 g | 2 g | No plating |
| 32 g | 10 g | 6 g | |
| 32 g | 10 g | 8 g | |
| 32 g | 10 g | 10 g | |
| 32 g | 10 g | 12 g | Darkened plating with streaking |
| 48 g | 10 g | 4 g | |
| 64 g | 10 g | 4 g | No plating |
| 32 g | 20 g | 4 g | |
| 32 g | 25 g | 4 g | |
| 32 g | 30 g | 4 g | Plating dull, but brightened with buffing |
| 32 g | 35 g | 4 g | Dull, uneven plating |

The plating solution of the present invention can not only be used for plating a wide range of metals onto a wide range of metals, it can also be used for as well. For example, a design was applied to the surface of a strip of brass using a rubber stamp and a bitumen material. The strip was then immersed in a solution as described in Example I together with a length of copper pipe. The strip was connected to the positive terminal of the 12V power supply and the copper pipe to the negative terminal, and current was allowed to flow through the solution. Ultimately, after etching of the exposed metal had occurred, the strip was removed and rinsed, and the bitumen removed. The areas of the strip covered with bitumen retained their shiny surface. By contrast, the areas not protected by the bitumen had been eroded, were no longer polished, and had an irregular surface.

The solution may likewise be used for anodic electrolytic cleaning by attaching the article to be plated to the positive terminal of the power source as above for the desired length of time. If the electrolytic cleaning proceeds for too long a period of time, of course, the surface can become etched and eroded. Once the electrolytic cleaning has been completed, the metal in solution may be removed using an inert anode as described herein, and the solution may thereafter be used for electroplating by attaching the article to the negative terminal and attaching a plating metal anode to the positive terminal of the power supply.

The foregoing embodiments of the invention have been provided for illustrative purposes, and, as those skilled in the art will be aware, modifications may be made to the foregoing within the scope of the invention.

The invention claimed is:

1. An acidic aqueous solution useable with a plating metal anode for electroplating plating metal from the anode onto an article comprising plating metal ions, oxalic acid, trisodium phosphate and ammonium sulfate present, respectively, in ratios by weight of 16-48 parts oxalic acid to 5-30 parts of trisodium phosphate and 2-10 parts ammonium sulfate.

2. The solution of claim 1 wherein the ratios by weight are 32 parts oxalic acid to 5-15 parts of trisodium phosphate and 4-8 parts ammonium sulfate.

3. The solution of claim 2 wherein the solution is free of chloride- or cyanide-containing compounds.

4. The solution of claim 1 wherein the ratios by weight are 16-48 parts oxalic acid to 5-25 parts of trisodium phosphate and 4-8 parts ammonium sulfate.

5. The solution of claim 1 wherein the solution is free of chloride- or cyanide-containing compounds.

6. The solution of claim 1 wherein the solution consists of water, oxalic acid, trisodium phosphate ammonium sulfate and plating metal ions, wherein the plating metal ions are provided in the solution by a plating metal anode.

7. The solution of claim 1 wherein no plating metal compounds, complexes or chelates are added to the electroplating solution.

8. A method of electroplating an article comprising:

providing an acidic aqueous solution between a plating metal anode and the article, the solution comprising oxalic acid, trisodium phosphate and ammonium sulfate, respectively, in ratios by weight of 16-48 parts oxalic acid to 5-30 parts of trisodium phosphate and 2-10 arts ammonium sulfate, and passing an electric current through the solution between the plating metal anode and the article to deposit plating metal from the anode onto the article.

9. The method of claim 8 wherein the ratios by weight are 32 parts oxalic acid to 5-15 parts of trisodium phosphate and 4-8 parts ammonium sulfate.

10. The method of claim 8 wherein the ratios by weight are 32 parts oxalic acid to 5-15 parts of trisodium phosphate and 4-8 parts ammonium sulfate.

11. The method of claim 8 wherein the solution consists of water, oxalic acid, trisodium phosphate and ammonium sulfate.

12. The method of claim 8 wherein the solution is free of plating metal compounds, complexes and chelates prior to the application of electric current between the anode and cathode.

13. The method of claim 8 wherein the plating metal anode and the article are at least partly immersed in a bath of the solution.

14. The method claim 8 wherein the plating metal anode is at least partly covered with a layer of an absorbent material and wherein electroplating solution is absorbed into the absorbent material.

15. The method of claim 8 wherein the plating metal is chosen from the group consisting of brass, copper, nickel, zinc, silver, gold, iron, manganese-nickel alloys, lead and stainless steel.

16. The method of claim 8 wherein the article comprises a metal selected from the group consisting of aluminum, brass, copper, nickel, steel, lead, stainless steel and zinc.

17. The method of claim 8 wherein a second anode of a second plating metal is used, and wherein current is also passed through the solution between this anode and the article, whereby a plating is created on the substrate comprising metal from both the plating metal anode and the second plating metal anode.

* * * * *